US012364912B2

(12) United States Patent
Motejunas et al.

(10) Patent No.: US 12,364,912 B2
(45) Date of Patent: Jul. 22, 2025

(54) SLOPE MEASURING SYSTEM FOR GOLF SHOES

(71) Applicants: Mark Motejunas, San Diego, CA (US); Lauren Bonneval, San Diego, CA (US)

(72) Inventors: Mark Motejunas, San Diego, CA (US); Lauren Bonneval, San Diego, CA (US)

( * ) Notice: Subject to any disclaimer, the term of this patent is extended or adjusted under 35 U.S.C. 154(b) by 30 days.

(21) Appl. No.: 18/513,846

(22) Filed: Nov. 20, 2023

(65) Prior Publication Data

US 2024/0390750 A1 Nov. 28, 2024

Related U.S. Application Data

(60) Provisional application No. 63/468,379, filed on May 23, 2023.

(51) Int. Cl.
*A63B 57/00* (2015.01)
*A63B 71/06* (2006.01)

(52) U.S. Cl.
CPC ..... *A63B 57/00* (2013.01); *A63B 71/0622* (2013.01); *A63B 2220/18* (2013.01);
(Continued)

(58) Field of Classification Search
CPC . A63B 57/00; A63B 71/0622; A63B 2220/18; A63B 2220/836
See application file for complete search history.

(56) References Cited

U.S. PATENT DOCUMENTS 5,437,289 A * 8/1995 Liverance ..... A63B 69/38 600/592
6,408,545 B1 * 6/2002 Song ..... A43B 5/001 36/137
(Continued)

FOREIGN PATENT DOCUMENTS

JP 7234531 B2 3/2023
KR 10-0935131 B1 1/2010
(Continued)

OTHER PUBLICATIONS

ADXL362 Data Sheet, "Micropower, 3-Axis, ±2 g/±4 g/±8 g Digital Output MEMS Accelerometer", Analog Devices, 2012, total of 47 pages.
(Continued)

*Primary Examiner* — Steven B Wong
(74) *Attorney, Agent, or Firm* — Collard & Roe, P.C.

(57) ABSTRACT

A system for measuring slope uses two measuring devices, each measuring device being configured to be mounted in a recess in a sole of a shoe. Each measuring device has a housing, an inertial sensor formed by an accelerometer and a gyroscope, a serial peripheral interface connected to the inertial sensor, and a microcontroller connected to the serial peripheral interface. A power source is connected to the microcontroller and a transmitter is connected to the SPI and microcontroller and wirelessly transmits data from the SPI and to the microcontroller. A remote receiver communicates wirelessly with the transmitter in each of the sensors to receive the position of each sensor and to control the sensors via the microcontroller. The receiver has a processor configured to calculate a slope between the two sensors based on the position data, and a display connected to the receiver to display the slope to a user.

6 Claims, 5 Drawing Sheets

(52) U.S. Cl.
CPC ..... *A63B 2220/836* (2013.01); *A63B 2225/50* (2013.01); *A63B 2225/74* (2020.08)

(56) References Cited

U.S. PATENT DOCUMENTS

| | | | | |
|---|---|---|---|---|
| 7,171,331 | B2 * | 1/2007 | Vock | A61B 5/0002 702/160 |
| 7,310,895 | B2 * | 12/2007 | Whittlesey | A63B 24/0003 36/137 |
| 7,610,688 | B2 | 11/2009 | Yun | |
| 7,676,961 | B2 * | 3/2010 | DiBenedetto | A43B 13/187 36/25 R |
| 7,823,301 | B2 * | 11/2010 | Belluto | A63B 69/3608 36/134 |
| 10,300,333 | B2 * | 5/2019 | Dau | A63B 69/3632 |
| 11,172,331 | B2 | 11/2021 | Czaja et al. | |
| 11,577,125 | B2 | 2/2023 | Onuki | |
| 2007/0206375 | A1 | 9/2007 | Piepgras et al. | |
| 2009/0235739 | A1 | 9/2009 | Morris Bamberg et al. | |
| 2010/0184563 | A1 * | 7/2010 | Molyneux | A43B 1/0054 473/570 |
| 2020/0016459 | A1 | 1/2020 | Smith | |
| 2022/0110407 | A1 | 4/2022 | Hettinga et al. | |
| 2022/0151332 | A1 * | 5/2022 | Gray | A43B 3/40 |
| 2022/0390620 | A1 * | 12/2022 | Nyhart | G01S 19/235 |
| 2024/0292923 | A1 * | 9/2024 | Molyneux | A63B 60/46 |

FOREIGN PATENT DOCUMENTS

| | | | |
|---|---|---|---|
| KR | 101151357 | B1 * | 6/2012 |
| KR | 10-2014-0043995 | A | 4/2014 |
| KR | 20230048672 | A * | 4/2023 |
| KR | 20230118443 | A * | 8/2023 |
| WO | 2015121691 | A1 | 8/2015 |

OTHER PUBLICATIONS

MPU-6000 and MPU-6050 Product Specification, Revision 3.4, InvenSense Inc., Aug. 19, 2013, total of 52 pages.

L3GD20H Data Sheet—production data, "MEMS motion sensor: three-axis digital output gyroscope", Mar. 2013, total of 52 pages.

PCT—Notification of the Transmittal of the International Search Report and the Written Opinion of the International Searching Authority, or the Declaration of International Application No. PCT/US 24/30303, Dated Sep. 5, 2024.

* cited by examiner

SLOPE MEASURING SYSTEM FOR GOLF SHOES

CROSS-REFERENCE TO RELATED APPLICATIONS

This application claims priority under 35 USC 119(e) of U.S. Provisional Application No. 63/468,379, filed on May 23, 2023, the disclosure of which is herein incorporated by reference.

BACKGROUND OF THE INVENTION

1. Field of the Invention

The present invention relates to a shoe-mounted device for measuring the slope of land on which the wearer is standing. This device uses inertial measurement units (IMUs) that combine accelerometer technology with gyroscopes mounted in the shoes to be able to provide accurate, real-time feedback regarding the slope measured between the two positional sensors placed into each golf shoes. This information is then communicated to an external device via wireless technology such as Bluetooth connectivity. The device can be encapsulated into removable elements, such as golf spikes, that can be placed in the corresponding receptacles in golf shoes, to aid golfers in accurately estimating the amount of break or curvature a golf shot may undergo.

2. The Prior Art

Various shoe-based sensor systems are known. For example, U.S. Pat. No. 7,310,895 B2 describes a shoe with sensors, controller and active-response elements and method for use thereof. Active-response golf shoes are disclosed. The golf shoes include at least one sensor, a controller, and at least one active-response element. The sensor and controller operate to rapidly determine if a golfer is walking or swinging a golf club. Once this determination is made the controller and active-response element rapidly change the shoe's characteristics. If the controller determines that the golfer is walking, the shoe provides a soft and flexible walking platform. If the controller determines that the golfer is swinging, the shoe morphs or changes automatically to provide a stable hitting platform. The controller senses various predetermined conditions such as pressure under the ball of the user's foot to determine whether the golfer is walking or swinging. The active-response elements may be a sole adjuster, a lace adjuster, and/or an upper adjuster. Methods of determining the golfer's type of movement are also disclosed.

Japanese Patent No. 7234531B2 discloses golf shoes with sensor device. Analyzing the course of a movement or motion sequences during an exercise or trainings sequence, e.g. swing for golf or tennis.

Korean Patent Application No. 20140043995A discloses an apparatus for converting a golf putting distance into a flatland distance and displaying the flatland distance and a method for controlling the same, wherein the apparatus comprises: a signal transmitting member installed inside a golf shoe and sensing a height of the golf green to wirelessly transmit a golf green height signal; and a portable signal receiving member for converting a distance between a hole cup and the green ground at which a golf ball is positioned into a flatland distance based on the golf green height signal that is wirelessly transmitted from the signal receiving member. According to the present invention as above, the portable signal transmitting member for sensing the height of the golf green and wirelessly transmitting a golf green height signal is mounted inside the golf shoe, and the portable signal receiving member receives the wirelessly transmitted golf green height signal, and then converts the distance between the golf ball and the hole cup into the flatland distance and displays the flatland distance. Therefore, at the time of golf putting, after the portable single receiving member precisely converts the distance between the hole cup and the putting location regardless of the height of the green and then displays the converted value, a golfer recognizes the converted and displayed information and thus conduct accurate putting, thereby maximizing the golf putting performance.

Korean Patent No. 100935131B1 discloses golf-shoes with a leveling instrument. The invention has an X-direction spirit level and a Y-direction spirit level on the golf shoes worn by the golfer at the time of rounding, so that the golfer wearing the golf shoes can see the height or inclination of the front, rear, left and right directions on the field or green at the point where the foot is stepped. The levels are installed in the front portion and side portions of the shoe. However, the level provides only basic information as to whether a slope is present, and the slope degree is not accurately determined. In addition, the foot position can alter the level results.

None of these devices accurately inform a golfer as to the slope of the course that the golfer is standing on. It would be desirable to provide a device that provides this information, and which is simple to install and operate, and which can be used with existing golf shoes.

SUMMARY OF THE INVENTION

It is therefore an object of the invention to provide a device that provides a golfer with an accurate slope determination on the golf course. It is another object of the invention to provide a device that can be simply and easily installed in and removed from existing golf shoes.

These and other objects of the invention are accomplished by system for measuring slope comprising two measuring devices, each measuring device being configured to be mounted in a recess in a sole of a shoe. Each measuring device comprises a housing and an inertial measurement unit (IMU) disposed in the housing. The inertial sensor integrates both an accelerometer and a gyroscope to determine the position of the sensor in space. A serial peripheral interface (SPI) connects the inertial sensor to a microcontroller and a transmitter. A power source is connected to the microcontroller. The transmitter is configured to wirelessly transmit data from the sensor to a remote receiver, via any suitable method, such as via wireless internet, or a short-range system such as BLUETOOTH®. The receiver contains a processor and a display. The receiver receives the data from each of the sensors via the transmitters, and calculates a slope between the two sensors based on the received position data of the sensors. The slope is then displayed to the user via the display. Alternatively or in addition, the microcontroller can perform some of the data manipulation internally. For example, the microcontroller can take data from the gyroscope and use it to "filter", i.e., provide some raw data manipulation to generate more accurate final position data to be transmitted to the external receiver.

The receiver is preferably a smartphone, tablet, smart watch or other portable device that a golfer can use during play. The utility of such a device will be such that a golfer need only to stand with feet apart to accurately measure the slope of a green surface. This will then allow the golfer to determine the amount of break he or she will need to play in order to best roll a putt or chip.

Preferably, the measuring devices are installed in soles of a pair of golf shoes, with each sensor in a separate shoe. The measuring devices are configured to be the same size and shape as a golf spike, and therefore can be easily installed in a standard golf shoe, replacing one of the spikes normally used. The devices are removable, and exchangeable among several different shoes. The housing is preferably constructed of plastic and is water-tight, to protect the electronic components inside.

The inertial measurement unit (IMU) is a low-power triple axis microelectromechanical systems (MEMS) accelerometer with a triple-axis MEMs gyroscope also integrated into the device. The size of the device has a low volume (i.e., less than 1 $in^3$). One such suitable IMU is the InvenSense MPU-6000 from TDK, which has dimensions of 4 mm×4 mm×0.9 mm. This IMU is an ultralow power, 3-axis MEMS accelerometer and 3-axis gyroscope with both SPI and I2C integrated communication capabilities. This particular IMU can operate on a wide 2.375 V to 3.46 V supply range, and can interface, if necessary, to a host operating on a separate, lower supply voltage. It has an on-chip 1024 byte FIFO buffer to further reduce power consumption and also has the ability to operate under sleep and wake activations to help further conserve power. The device features three 16-bit analog-to-digital converters (ADCs) for digitizing the gyroscope outputs and three 16-bit ADCs for digitizing the accelerometer outputs. For precision tracking of both fast and slow motions, the parts feature a user-programmable gyroscope full-scale range of ±250, ±500, ±1000, and ±2000°/sec (dps) and a user-programmable accelerometer full-scale range of ±2 g, ±4 g, ±8 g, and ±16 g.

Other types of inertial sensors or any combination of individual accelerometers and or gyroscopes could also be used and wired appropriately. For example, the Panasonic EWTS5G 6 in 1 sensor has a combination of 3 accelerometers and 3 gyroscopes in a single MEMs chip. If more cost effective, one could also use suitable separate accelerometers such as the ADXL362 from Analog Devices, which has dimensions of 3 mm×3.25 mm×1.06 mm and link it to the a micro-electromechanical systems (MEMS) gyroscope such as the L3GD20H from ST micro measuring 3×3×1 mm.

The transmitter is preferably a low energy BLUETOOTH® converter module such as the nRF52832 from Nordic Semiconductor. A microcontroller such as the Arduino Nano or a similar device allows the sensors to be controlled via a BLUETOOTH® application in the remote receiver. The power source preferably will be a small battery such as a non-rechargeable coin-cell battery such as the 3-volt CR2032.

A voltage modulator can be used to regulate the power delivery to the required voltage for the accelerometer, gyroscope and microcontroller. As needed additional capacitors and resistors can be integrated into the circuit to regulate power delivery. Small LED indicator lights can placed on the plantar aspect of the housing to indicate power on/off as well as wireless connectivity.

The measuring devices can be connected to a switch so that the power to the measuring devices can be controlled by the processor in the receiver. This way, the user can turn the sensors on and off from the remote receiver via the receiver controlling the switch.

The slope can calculated by the processor in the remote device using a software program that converts the positional data from the sensors into slope data. The calculations are as follows:

Determine the height difference between the two sensors by subtracting the height of sensor "A" from the height of sensor "B". The distance between the two sensors is determined by measuring the distance between the centers of the sensors. The height difference would be divided by the distance between the sensors to get the percent slope using the following formula:

$$\text{Percent slope}=(\text{height difference}/\text{distance between sensors})\times 100.$$

The inertial sensor is preferably programmable to alternate settings to instead provide the actual slope in degrees. This will be done as follows:

Using the x, y and z data from each sensor, the horizontal plane can be determined using the Madgwick or fusion algorithm to integrate the data of the accelerometer and gyroscope in each sensor. Once the orientation of each sensor is calibrated using simple trigonometric equations, the slope is then calculated in degrees with the arctangent function. The difference in the pitch angle between the two sensors is determined. The pitch angle is the angle between the x-axis of each sensor and the horizontal plane. This can be calculated as the arctangent of the ratio of the y and z acceleration values for each sensor. Then, the difference in the roll angle between the two sensors is calculated. The roll angle is the angle between the y-axis and the horizontal plane. This can be calculated as the arctangent of the ratio of the x and z acceleration values for each sensor. The angle between the two sensors is the square root of the sum of the squares of the pitch and roll angles. Finally, this can be converted to degrees by converting the angle between the two sensors from radians to degrees. A mathematical Kalman filter can be used to further increase the accuracy of the information the device provides by decreasing the overall noise in the measurements or other uncertainties. This slope in degrees is then displayed to the user on the display.

The housing is comprised of an impact- and water-resistant material, and is sealed around the measuring devices to prevent mechanical or water damage during use.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
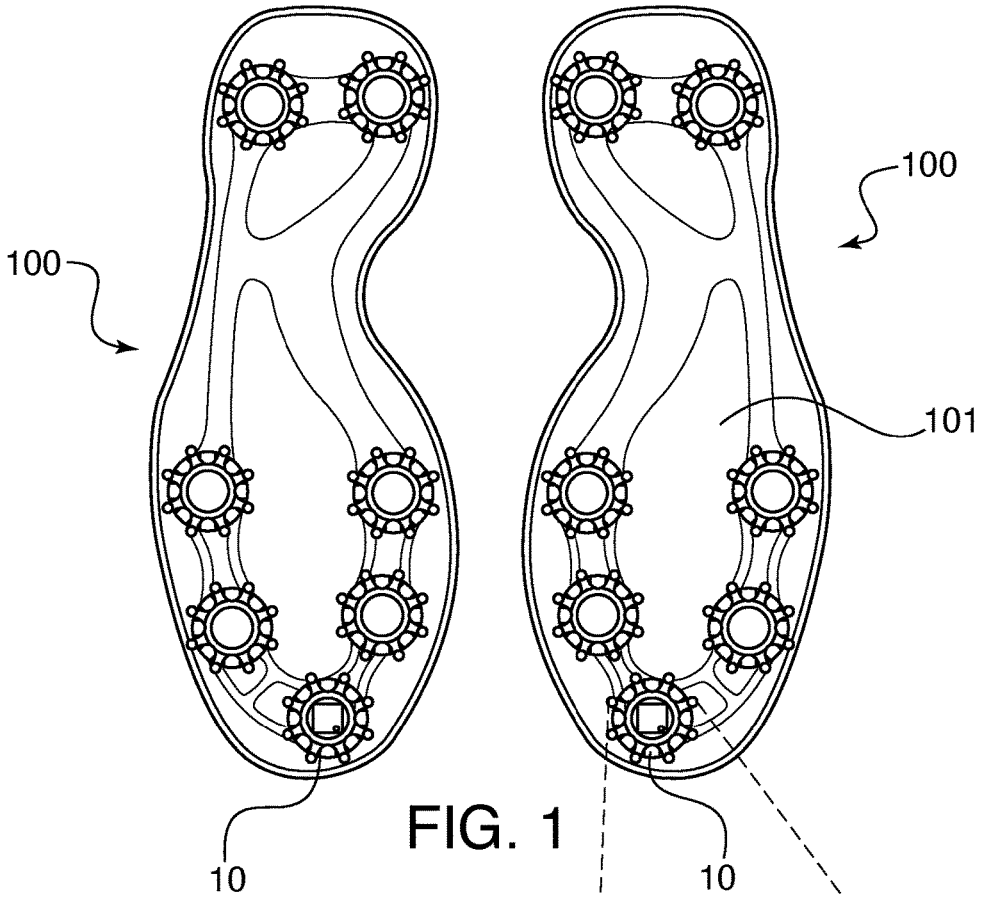
FIG. 1 shows a bottom view of a pair of golf shoes, having the measuring devices of the invention installed in one of the spike receptacles.

Referring now in detail to the drawings, FIG. 1 shows a pair of golf shoes 100, 100, each having one measuring device 10 mounted in a spike receptacle in the sole 101 of the golf shoe 100. The measuring device 10 can be made to fit standard spike receptacles in a variety of shoe types, so that it can be used interchangeably among several pairs of shoes.

Figure 1A:
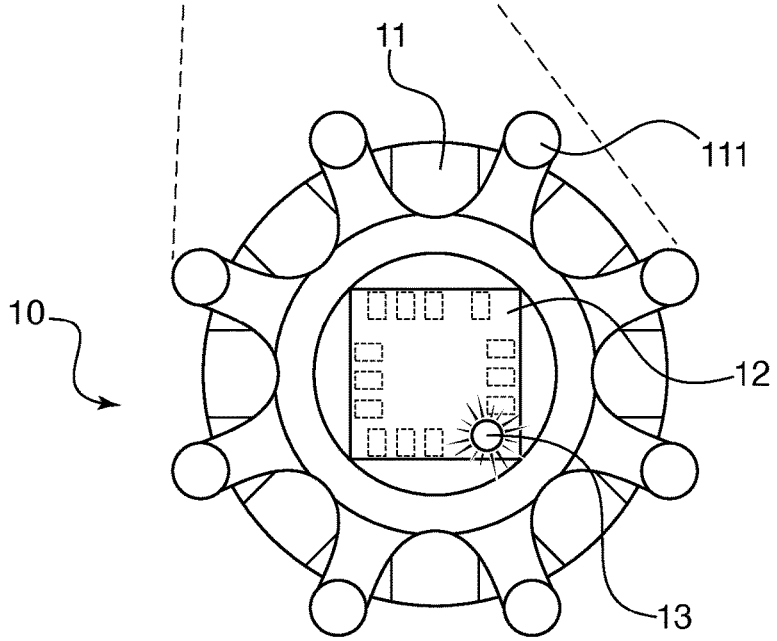
FIG. 1A is an enlarged view of one of the measuring devices used in the system according to the invention.

An enlarged view of measuring device 10 is shown in FIG. 1A. Measuring device 10 consists of a housing 11 containing several spikes 111, that function in the same way as a standard golf spike, i.e., to grip the surface on which the golfer is standing to provide extra stability during a golf swing. A screw 112 (shown in FIG. 12) connects measuring device 10 to shoe 100. Within housing 11 is a cavity that holds an inertial sensor 12. An indicator light 13 is connected to sensor 12 to indicate to the use whether sensor 12 is powered up and in use, as described below. Housing 11 is preferably comprised of a molded plastic that is impact-resistant, and is sealed around the measuring device 10 to prevent water from reaching measuring device 10.

Figure 2:
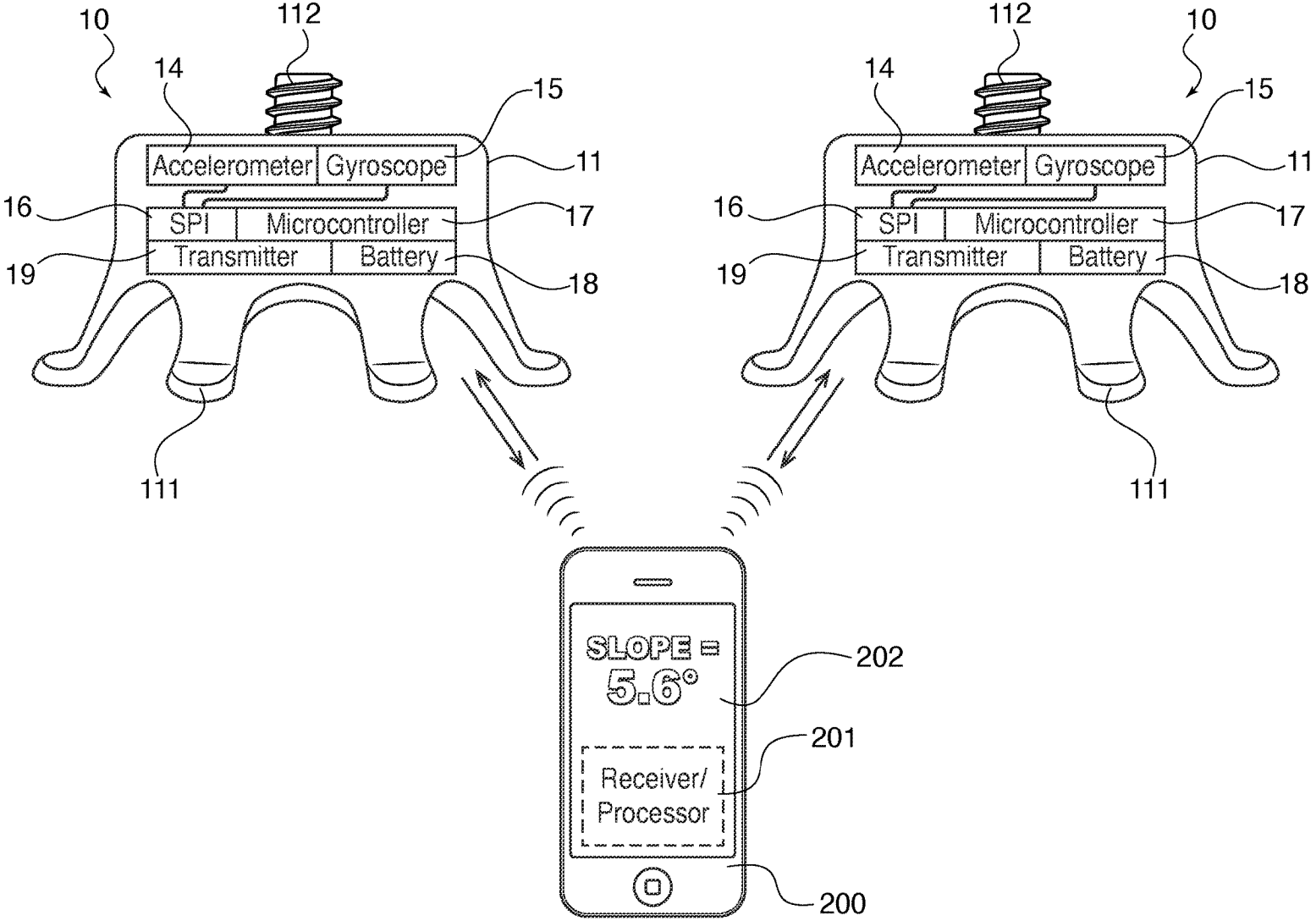
FIG. 2 is a schematic diagram of the complete system according to the invention.
Figure 3:
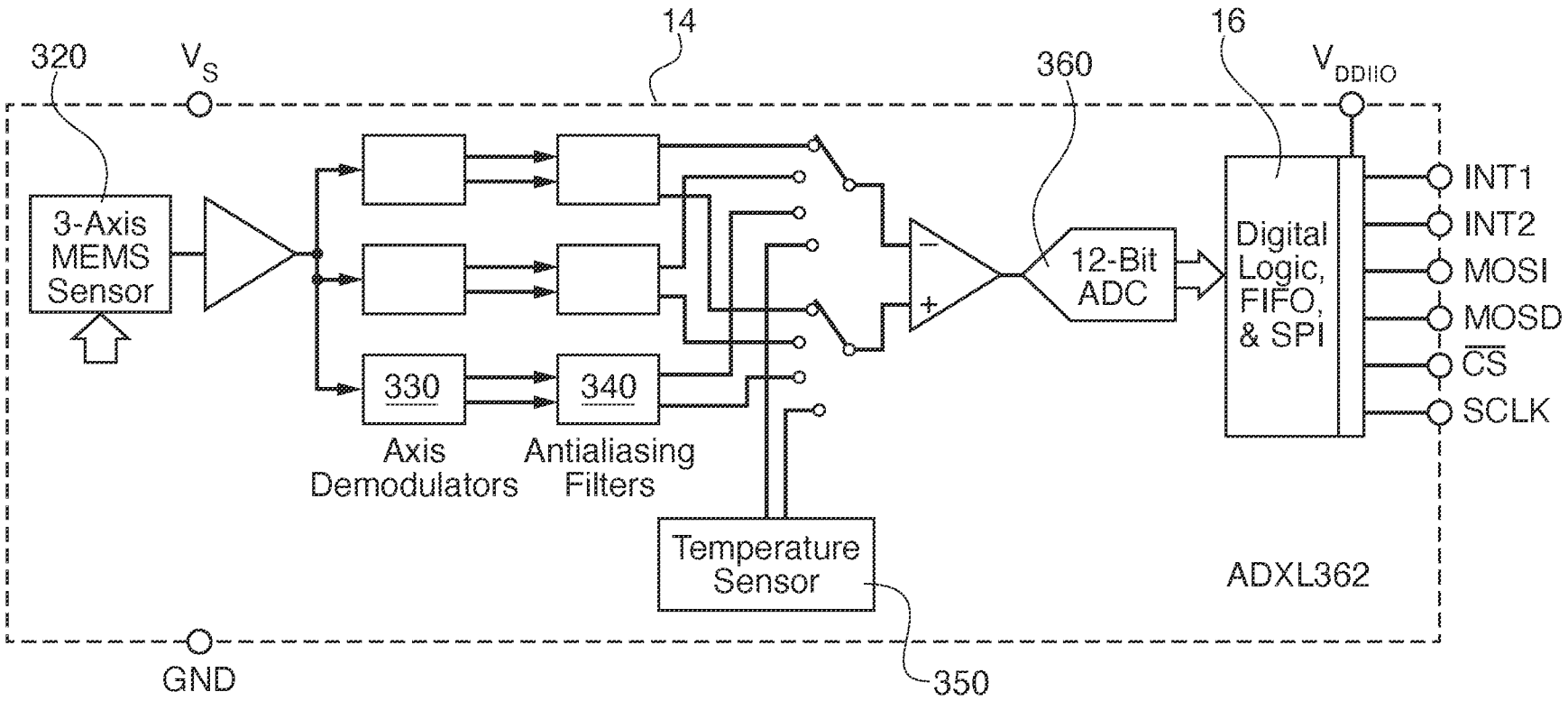
FIG. 3 is a schematic diagram of the accelerometer used in the measuring devices of the invention.
Figure 4:
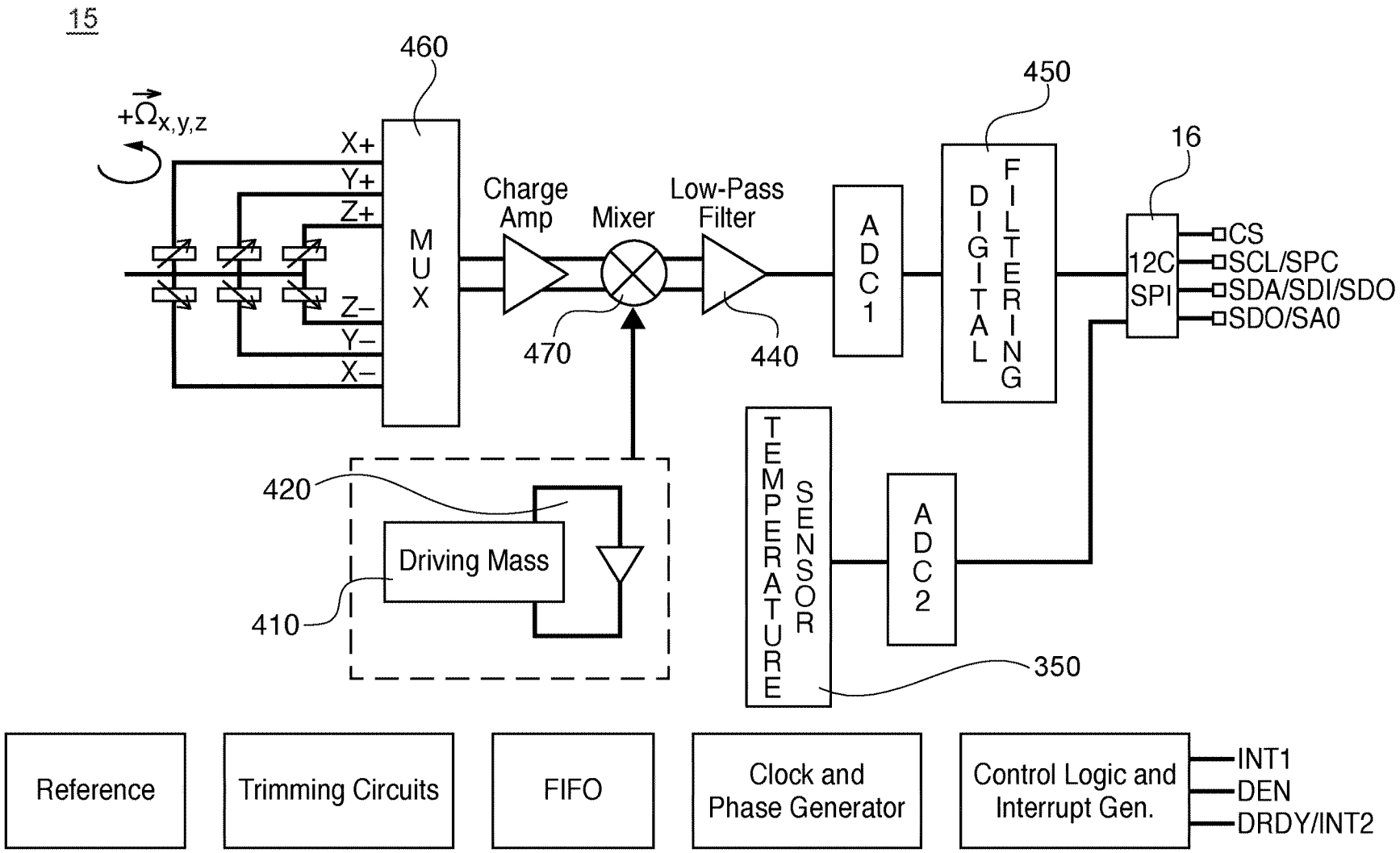
FIG. 4 is a schematic diagram of the gyroscope used in the measuring devices of the invention.

The internal components of the inertial sensor 12 are shown in FIGS. 2-4. Each shoe 100 contains an identical measuring device 10 with inertial sensor 12. Inertial sensor 12 is comprised of a MEMS accelerometer 14 and a MEMS gyroscope 15, which are connected via a serial peripheral interface (SPI) 16 to a microcontroller 17. Microcontroller 17 is also connected to a power source in the form of a battery 18 and a transmitter 19. In use, data from accelerometer 14 and gyroscope 15 and combined via SPI 16 and transmitted to microcontroller 17, which then transmits the data via transmitter 19 to a remote device 100 having a receiver with a processor 201. The data received by processor 201 is combined and analyzed by software to produce a slope calculation between the two measuring devices 12. The slope is then displayed on a display 202 of the remote device 200, so that the user can view the slope on which a golf ball lies prior to hitting the ball during a game of golf.

A detailed diagram of an accelerometer 14 that can be used in the invention is shown in FIG. 3. The accelerometer can be the ADXL362 by Analog Devices, or any other suitable accelerometer. The accelerometer has a 3-axis mems sensor 320 connected to axis demodulators 330, antialiasing filters 340, a temperature sensor 350, a 12-bit analog-to digital converter 360 which is connected to the SPI 16. The SPI has ports for SCLK SPI Communications Clock, MOSI Master Output, MOSD Slave Input, CS SPI Chip Select, INT2 Interrupt 2 Output, INT1 Interrupt 1 Output, and connections to ground GND and supply voltage VS.

A schematic diagram of a gyroscope 15 that can be used with the invention is shown in FIG. 4. The gyroscope 15 can be the L3GD20H by ST Microelectronics, or any other suitable gyroscope. The vibration of the driving mass 410 is maintained by a drive circuitry in a feedback loop 420. The sensing signal is filtered via a low pass filter 340 and a digital filter 350 and appears as digital signal at the output via the SPI 16. A multiplexer 460 and mixer 470 are used to mix and amplify the signals. SPI 16 then combines the signals of the accelerometer and gyroscope to accurately determine a position of each of the measuring devices 10.

Figure 5:
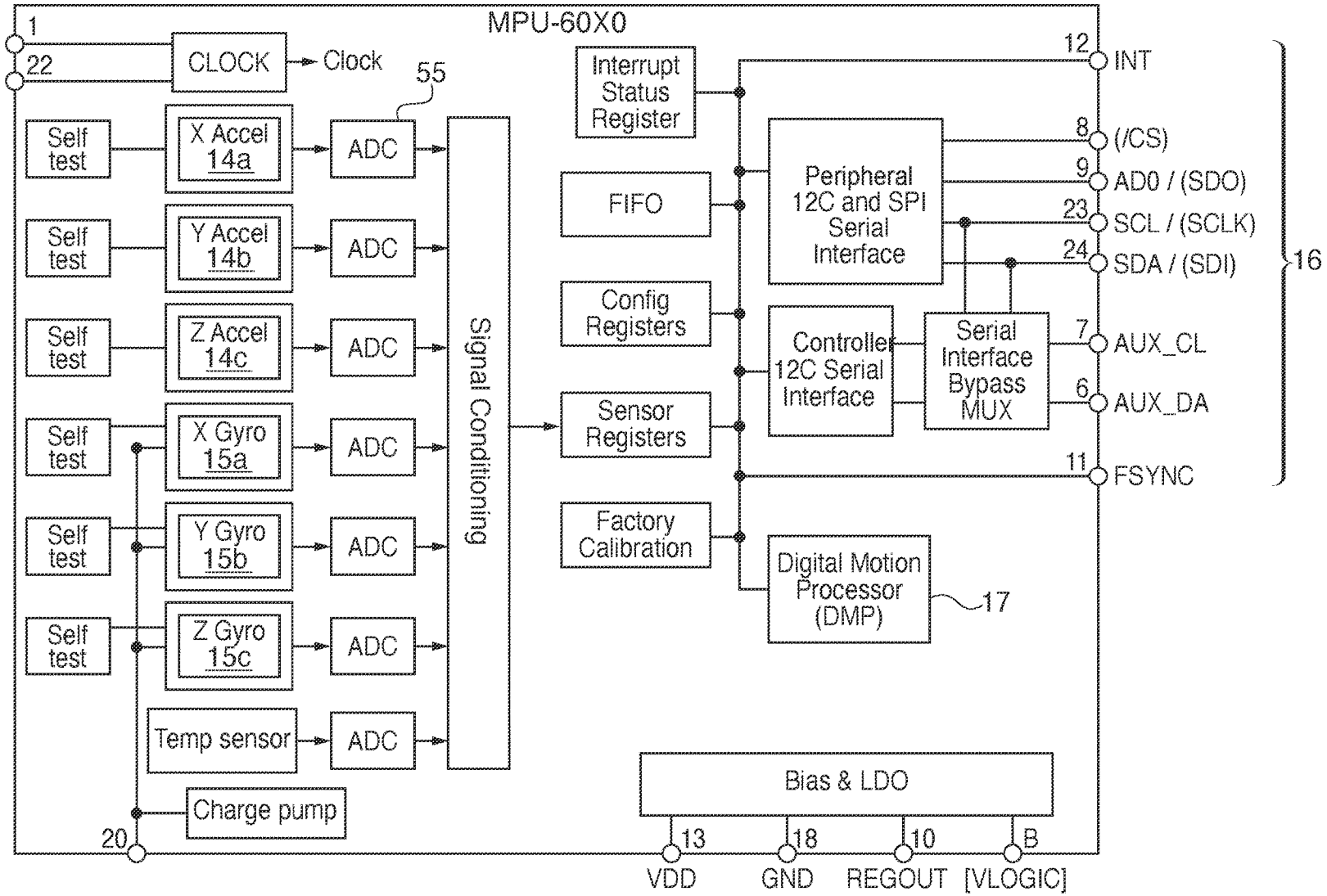
FIG. 5 is a schematic diagram of a combination gyroscope/accelerometer for use in the invention.

Alternatively, a single chip with both the gyroscope 15 and accelerometer 14 can be used, such as the MPU-6000 from TDK, which is shown in FIG. 5. Here, gyroscope 15 consists of 3 vibratory MEMS rate gyroscopes 15*a*, 15*b*, 15*c*, which detect rotation about the X-, Y-, and Z-axes. When the gyros are rotated about any of the sense axes, the Coriolis Effect causes a vibration that is detected by a capacitive pickoff. The resulting signal is amplified, demodulated, and filtered to produce a voltage that is proportional to the angular rate. This voltage is digitized using individual on-chip 16-bit Analog-to-Digital Converters (ADCs) 55 to sample each axis. The full-scale range of the gyro sensors may be digitally programmed to ±250, ±500, ±1000, or ±2000 degrees per second (dps). The ADC sample rate is programmable from 8,000 samples per second, down to 3.9 samples per second, and user-selectable low-pass filters enable a wide range of cut-off frequencies. Combined in a single chip with gyroscopes 15*a*, 15*b* and 15*c* is a 3-Axis accelerometer 14 that uses separate proof masses 14*a*, 14*b*, 14*c* for each axis. Acceleration along a particular axis induces displacement on the corresponding proof mass, and capacitive sensors detect the displacement differentially. The architecture of this structure reduces the accelerometers' susceptibility to fabrication variations as well as to thermal drift. When the device is placed on a flat surface, it will measure 0 g on the X- and Y-axes and +1 g on the Z-axis. The accelerometer and gyroscope data are transmitted via the SPI to the microcontroller 17 as described above with respect to FIG. 2.

The processor 201 calculates the slope between the two sensors 10 by determining the height difference between the two sensors by subtracting the height of one sensor from the height of the other sensor. The distance between the two sensors is determined by measuring the distance between the centers of the sensors as determined the positional data transmitted by the sensors 12. The height difference is divided by the distance between the sensors to get the percent slope using the following formula:

$$\text{Percent slope}=(\text{height difference}/\text{distance between sensors})\times 100.$$

The processor can also calculate the actual slope in degrees. This will be done as follows:

Using the x, y and z data from each sensor, the horizontal plane is be determined using the Madgwick or fusion algorithm to integrate the data of the accelerometer and gyroscope in each sensor. Once the orientation of each sensor is calibrated, the slope is then calculated in degrees with the arctangent function. The difference in the pitch angle between the two sensors is determined. The pitch angle is the angle between the x-axis of each sensor and the horizontal plane. This can be calculated as the arctangent of the ratio of the y and z acceleration values for each sensor. Then, the difference in the roll angle between the two sensors is calculated. The roll angle is the angle between the y-axis and the horizontal plane. This can be calculated as the arctangent of the ratio of the x and z acceleration values for each sensor. The angle between the two sensors is the square root of the sum of the squares of the pitch and roll angles. Finally, this is converted to degrees by converting the angle between the two sensors from radians to degrees. A mathematical Kalman filter will likely be used to further increase the accuracy of the information the device provides by decreasing the overall noise in the measurements or other uncertainties. This slope in degrees is then displayed to the user on the display.

The system of the present invention provides a golfer with a simple and accurate determination of the slope on which he or she is standing, which allows the golfer to adjust their shots accordingly.

Accordingly, while only a few embodiments of the present invention have been shown and described, it is obvious that many changes and modifications may be made thereunto without departing from the spirit and scope of the invention.

What is claimed is:

1. A system for measuring slope comprising:

two measuring devices, each measuring device being configured to be mounted in a recess in a sole of a shoe, wherein each measuring device comprises:

a housing;

an inertial sensor disposed in the housing, the inertial sensor comprising an accelerometer and a gyroscope and being configured to measure a position of the sensor;

a serial peripheral interface connected to the accelerometer and gyroscope;

a microcontroller connected to the serial peripheral interface;

a power source connected to the microcontroller;

a transmitter/receiver connected to the microcontroller and serial peripheral interface and being configured to wirelessly send data from the sensor, a remote receiver configured to communicate wirelessly with the transmitter/receiver in each of the sensors to receive data from each sensor and to control the microcontroller, the remote receiver having a processor programmed with software so as to be configured to calculate a slope between the two sensors based on the received data, and a display connected to the remote receiver and being configured to display the slope to a user, wherein each housing has a screw on a top surface so that the housing is configured for screwing the measuring device into a bottom of a shoe.

2. The device according to claim 1, wherein the measuring devices are installed in soles of a pair of golf shoes, with each sensor in a separate shoe.

3. The device according to claim 2, wherein the measuring devices are installed in recesses for spikes or cleats.

4. The system according to claim 1, wherein the processor calculates the slope by determining a pitch angle of each of the inertial sensors.

5. The system according to claim 1, further comprising a voltage modulator connected to the power source in each of the sensors.

6. The system according to claim 1, further comprising an indicator light disposed on the housing and connected to the power source.

* * * * *